US006368131B1

(12) United States Patent
Takeuchi et al.

(10) Patent No.: US 6,368,131 B1
(45) Date of Patent: Apr. 9, 2002

(54) WATERPROOF ELECTRICAL CONNECTOR

(75) Inventors: Yoshiaki Takeuchi; Toru Takeda; Yoshihiro Nakazawa, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/657,924

(22) Filed: Sep. 8, 2000

(30) Foreign Application Priority Data

Sep. 9, 1999 (JP) ..... 11-255331

(51) Int. Cl.[7] ..... H01R 13/52
(52) U.S. Cl. ..... 439/271; 439/587
(58) Field of Search ..... 439/271, 272, 439/273, 682, 692, 586, 587

(56) References Cited

U.S. PATENT DOCUMENTS 4,903,402 A * 2/1990 Norton et al. ..... 29/843
5,234,356 A 8/1993 Maejima et al. ..... 439/352

FOREIGN PATENT DOCUMENTS

JP U2-18279 2/1990

* cited by examiner

*Primary Examiner*—Gary Paumen
*Assistant Examiner*—Ann McCamey
(74) *Attorney, Agent, or Firm*—Birch, Stewart, Kolasch & Birch, LLP

(57) ABSTRACT

The waterproof electrical connector achieves a seal between an end portion of a socket housing and a seal member in a pin housing. The seal member may be elastic, and forms a seal that allows for easy withdrawal and insertion of the socket housing in the pin housing. The seal member may have an arcuate surface that engages the end portion of the socket housing. The socket housing has a rectangular transverse cross-section that allows for dense packing of female terminals.

10 Claims, 5 Drawing Sheets

Fig. 7
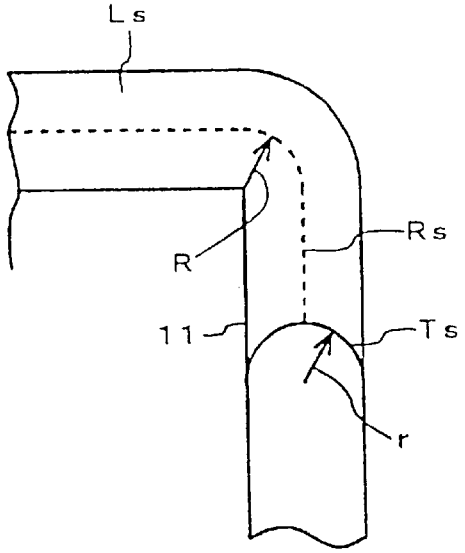
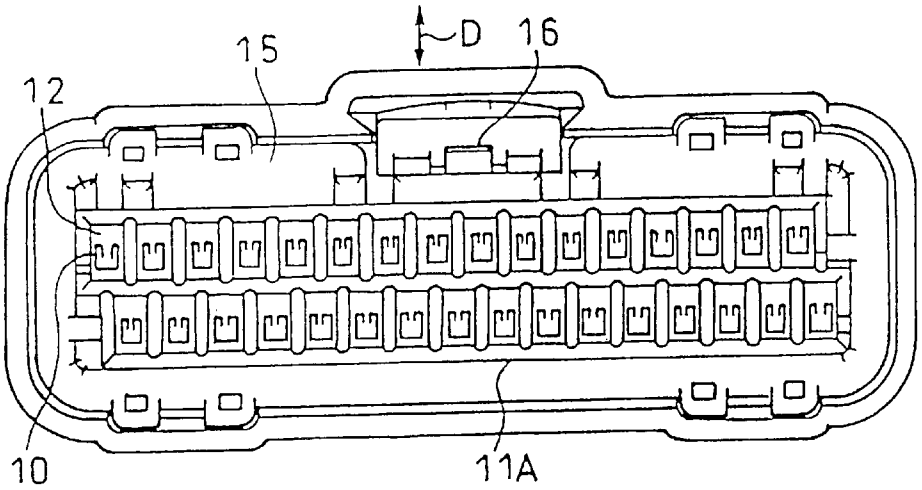
Fig. 8

WATERPROOF ELECTRICAL CONNECTOR

BACKGROUND OF THE INVENTION

1. Field of Invention

The present invention relates to an electrical connector, and more particularly, to an electrical connector suitable for making a large number of poles individually waterproof.

2. Background Art

Recently, vehicular controls have been upgraded, and ignition timing control, fuel injection control, and suspension control devices involving many input and output signals are now included on vehicles. In such devices involving many input and output signals, it is becoming more and more popular to adopt a connection form which utilizes a connector (coupler) for the purpose of facilitating maintenance, reducing the number of connections to enhance reliability, or drawing out a coupler terminal directly from substrate terminals to improve production efficiency. In the connection form using a connector, it is desirable to utilize a waterproof structure for each pole in order to attain high reliability waterproofing.

A conventional waterproof electrical connector is known having a seal applied to each of many connecting terminals (i.e., poles). FIG. 11 is a sectional view of such a conventional waterproof electrical connector, as disclosed in Japanese Utility Model Laid Open No. Hei 2-18279. In FIG. 11, contacts, or female terminals 101, are each held in a socket housing 100, while in a pin connector housing 200 is molded pin connectors, i.e., male terminals 201.

A front end 100*a* of the socket housing 100 is formed in a cylindrical shape to accommodate the female terminals 101 each individually, while in the pin connector housing 200 is received a sealing member 202 in conformity with the outer periphery of the cylindrical shape of the front end 100*a* of the socket housing 100, so as to ensure a liquid-tight condition.

The sealing member 202 is formed of an elastic material such as rubber, and a section of its inner peripheral surface, i.e., a section thereof in an extending direction of the female terminals 101, is corrugated for facilitating the deformation thereof upon abutment against the front end 100*a* of the socket housing 100, and for increasing the abutting pressure. Further, a sealing stopper 300 is fitted in the pin connector housing 200 to prevent the sealing member 202 from coming off of the pin connector housing 200.

In the above conventional waterproof connector, each connecting terminal is waterproof. However, it has several shortcomings. First, since sealing members 202 are pressed respectively against a large number of cylindrical front ends 100*a* of the socket housing to provide a seal, there is a large frictional force between the sealing members 202 and the socket housing 100. Therefore, the force required to either insert or pull the connector out is large. Secondly, since the sealing members are disposed so as to enclose the cylindrical front ends of the socket housing concentrically, a large space is required, and the larger the number of connecting terminals, the larger the space. This is particularly undesirable in a two-wheeled motor vehicle in which mounting space is limited. Thirdly, if the connecting terminals used are of a circular sectional shape, a still greater space is required.

A need therefore exists for a connector that can be maintained in a waterproof condition and which does not require excessive force for connecting and disconnecting. A need further exists for a connector that can be maintained in a waterproof condition without occupying excessive space.

SUMMARY OF THE INVENTION

It is therefore an object of the present invention to provide a electrical connector capable being held in a waterproof condition. It is a further object of the invention to provide an electrical connector that is capable of being connected and disconnected easily.

It is a further object of the invention to provide an electrical connector that can be maintained in a waterproof condition without occupying excessive space.

For achieving the above-mentioned objects and other objects, a first feature of the present invention resides in an electrical connector for connecting a plurality of male terminals and a plurality of female terminals with each other, comprising a pin housing which holds the male terminals, a socket housing having receptacle portions for accommodating and holding the female terminals each individually, and an elastic sheet member disposed so that a cylindrical edge of the socket housing comes into abutment against the elastic sheet member when the socket housing is fitted in the pin housing to form a seal between the pin housing and the socket housing.

According to this first feature, the socket housing and the pin housing are coupled together through the elastic sheet member. As a result, the receptacle portions are sealed with the elastic sheet member, and the male and female terminals received within the receptacle portions are waterproof when both housings are coupled together. Further, since the socket housing is sealed at only its front end side, i.e., its cylindrical edge, a frictional force of the elastic sheet member does not act in a direction in which it obstructs the socket housing connecting/disconnecting operation. Consequently, both housings can be easily engaged and disengaged with respect to each other.

A second feature of the present invention resides in that a sectional shape of the receptacle portions of the socket housing perpendicular to a socket housing connecting/disconnecting direction is square. According to the second feature, the space for arrangement of a large number of terminals can be used more effectively than in connectors having receptacle portions for accommodating terminals having a circular shape.

A third feature of the present invention resides in that either the cylindrical edge of the socket housing or a surface of the elastic sheet against which the cylindrical edge comes into abutment is formed as an arcuate convex portion. According to the third feature, when the socket housing and the pin housing are coupled together, the top of the arcuate convex portion comes into abutment against the corresponding surface to ensure a waterproof sealing effect.

A fourth feature of the present invention resides in that the convex portion is formed by a continuation of circular arcs having a single radius of curvature and is annular around the male or female terminals. According to this fourth feature, no change in shape occurs at a crossing part of sides in each cylindrical receptacle portion having a square section. That is, the mating member upon abutment thereagainst of the convex portion undergoes a smooth deformation, so that the sealing effect is enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is an enlarged view of a portion of the second embodiment of the socket housing;

FIG. 8 is a front view of a socket housing in a multi-core connector;

DETAILED DESCRIPTION OF THE PREFERRED EMBODIMENTS

Figure 2:
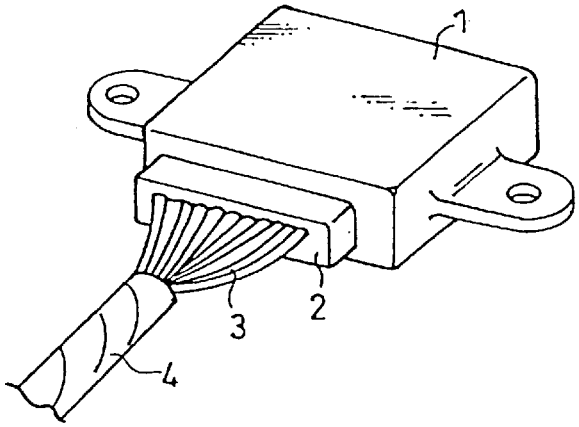
FIG. 2 is a perspective view of a control unit including the connector.

The present invention will be described in detail below with reference to the drawings. FIG. 2 is a perspective view of an electrical connector according to an embodiment of the present invention. A connector 2 is connected to a control unit 1 which is used, for example, for controlling an automobile. A multi-core cable 4 composed of a large number of lead wires 3 is connected to the connector 2 in a tightly packed manner. The lead wires 3 are connected to the control unit 1 through the connector 2.

Figure 1:
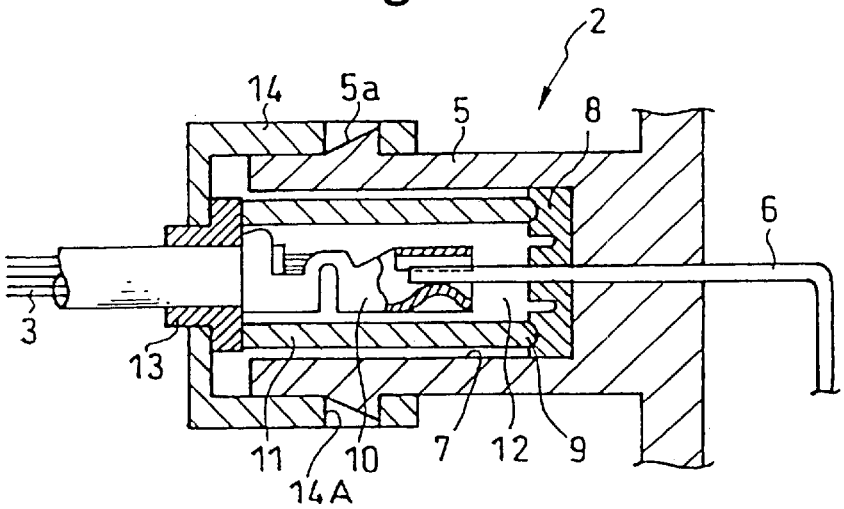
FIG. 1 is a sectional view of an electrical connector according to an embodiment of the present invention.

FIG. 1 is a sectional view of the connector 2, taken along an extension line of one of the lead wires 3. A pin connector housing (hereinafter referred to as "pin housing") 5, which is fixed on the control unit 1 side, may be formed of an electric insulating material, such as a resin, and is molded integrally with male terminals 6 which may be present in the same number as the number of the lead wires 3. One end of each male terminal 6 extends through the pin housing 5 and projects into a socket receiving recess 7. The opposite end of the male terminal 6 is connected to, for example, a substrate (not shown) disposed within the control unit 1. A sealing member 8 is fixed to the bottom of the socket receiving recess 7 formed in the pin housing 5. The sealing member 8 may be formed of an elastic material, such as rubber, and can be deformed elastically to match the curvature of an end portion (edge) 9 of a socket housing 11.

Female terminals 10 for coupling with the male terminals 6 to bring about a desired electrically connected state are fixedly connected to end portions of the lead wires 3. In the socket housing 11, there are formed the same number of receptacle holes 12 as the number of the female terminals 10, and the female terminals 10 are accommodated within the receptacle holes 12 each individually. On the outer periphery of an end portion of each lead wire 3 is provided a sealing grommet 13 for holding the vicinity of the connection between each female terminal 10 and each lead wire 3 in a sealed state. A locking cap 14 is provided for holding the sealing grommet 13 and for pressing the socket housing 11 against the sealing member 8 through the sealing grommet 13. The locking cap 14 is fitted on the outer periphery of an end portion of the pin housing 5, and holds the socket housing 11 at a predetermined position relative to the pin housing by engagement of holes 14A formed therein with pawls **5*a* formed on the pin housing 5**.

Figure 3:
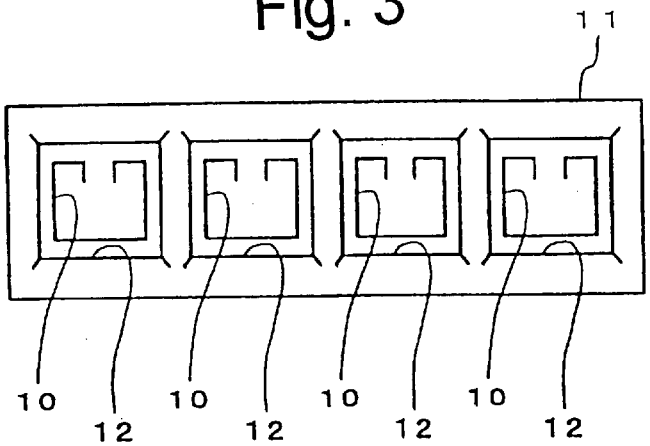
FIG. 3 is a front view of a socket housing.
Figure 4:
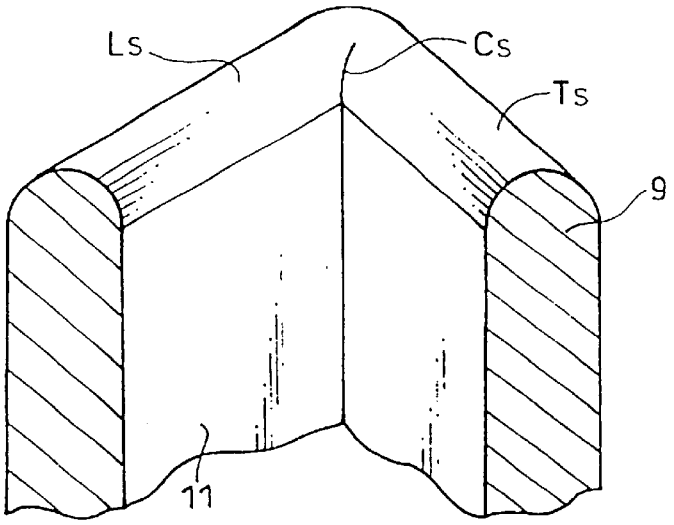
FIG. 4 is a perspective view of a portion of the socket housing.

FIG. 3 is a front view of the socket housing 11, i.e., a view of the socket housing 11 as seen from the pin housing 5 side, and FIG. 4 is a perspective view of a portion of the socket housing 11. As shown in FIG. 3, the socket housing 11 has lattice-like partitioned receptacle holes 12, in each of which is received a female terminal 10 of a square section conforming to the lattice shape. Since the edge 9 of the socket housing 11 is of an arcuate section, as shown in FIG. 1, an intermediate shape changing portion, e.g., a crossing portion Cs, between a longitudinal portion Ls and a transverse portion Ts of the lattice, is depressed like a trough (see FIG. 4).

Figure 5:
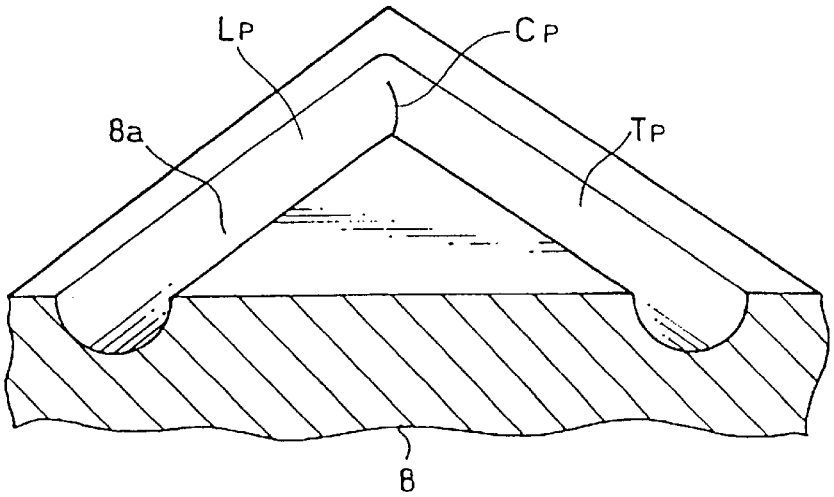
FIG. 5 is a perspective view of a portion of an elastic sheet.

FIG. 5 is a perspective view of a portion of the sealing member 8, which portion is deformed by being pushed with the edge of the socket housing 11. The sealing member 8 is formed with a groove **8*a* so as to conform to an external shape of the edge 9 of the socket housing 11 when abutted by the edge 9. An intermediate shape changing portion of the groove 8*a*, e.g., a crossing portion Cp between a longitudinal portion Lp and a transverse portion Tp of the groove 8a, projects in a chevron shape so as to conform to the trough-like crossing portion Cs of the socket housing 11. In order for the crossing portion Cp to conform to the crossing portion Cs at the edge of the socket housing 11, it is necessary that the crossing portion Cp be deformed into a shape similar to a bow edge. When using an elastic material such as rubber, however, it is impossible to obtain a desired deformation, and a gap may be formed between the edge of the socket housing 11 and the sealing member 9**.

Figure 6:
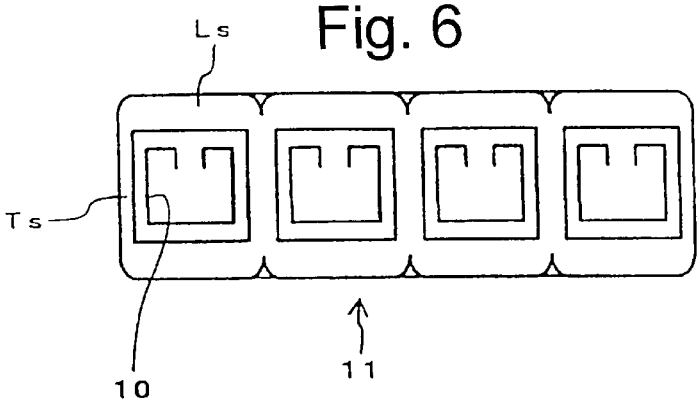
FIG. 6 is a front view of a second embodiment of the socket housing.

The above problem can be solved by forming the edge 9 of the socket housing 11 and the groove **8*a* of the sealing member 8 in the following shapes. FIG. 6 is a front view of the socket housing 11 and FIG. 7 is an enlarged diagram of a portion of the socket housing. In both figures, the longitudinal portion Ls and the transverse portion Ts of the socket housing 11 are arcuate convex portions having a radius of curvature r. Likewise, a corner portion which connects the longitudinal and transverse portions Ls, Ts with each other has an arcuate sectional shape having the radius of curvature r. Therefore, in the longitudinal and transverse portions Ls, Ts, an edge is formed by continuous arcs having a single radius of curvature r. Therefore, a line joining the tops of the arcs, e.g., a crest line Rs, is continuous through an arcuate portion with a curvature radius R. Such a trough-like crossing portion as in FIG. 4** is not formed between the longitudinal portion Ls and the transverse portion Ts.

Therefore, the edge of the socket housing 11 is formed wholly as a convex portion comprising continuous arcs with a certain radius r, and the crest line Rs is made continuous with a certain radius R, whereby a trough-like crossing portion is not formed. Consequently, even if the groove **8*a* of the sealing member 8 is not deformed in such a bow edge shape as shown in FIG. 5, the edge 9 of the socket housing 11 and the sealing member 8** come into close contact with each other, thereby permitting a satisfactory waterproofing effect to be obtained with a small pressing force.

Figure 9:
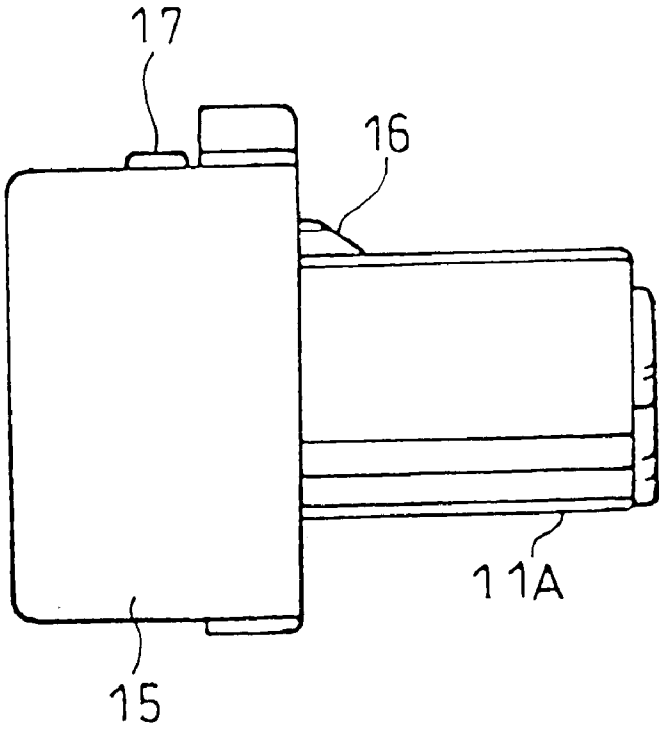
FIG. 9 is a side view of a socket housing in a multi-core connector.

FIG. 8 is a front view showing an example of a socket housing in which female terminals are arranged in two stages, and FIG. 9 is a side view thereof. As shown in both figures, a socket housing 11A has a total of thirty-two receptacle holes 12 (sixteen for each of upper and lower stages) for accommodating female terminals 10, with its end portion, or edge, being formed in a lattice shape. A body 15 which holds the socket housing 11A is formed with a hook 16 capable of being deformed in the directions of arrows D. The hook 16 deforms itself in the direction of arrow D to permit fitting of a pin housing and the socket housing II A with each other. When both housings are to be disengaged from each other, the hook 16 is deformed in the direction of arrow D by pushing a protuberance 17 which is integral with the hook 16, thereby permitting the disengagement.

Figure 10:
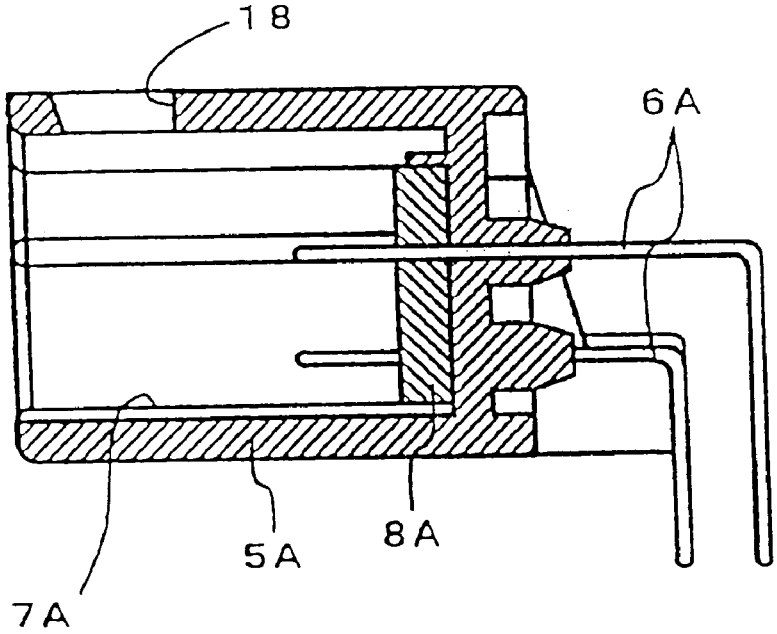
FIG. 10 is a sectional side view of a pin housing used in the multi-core connector.
Figure 11:
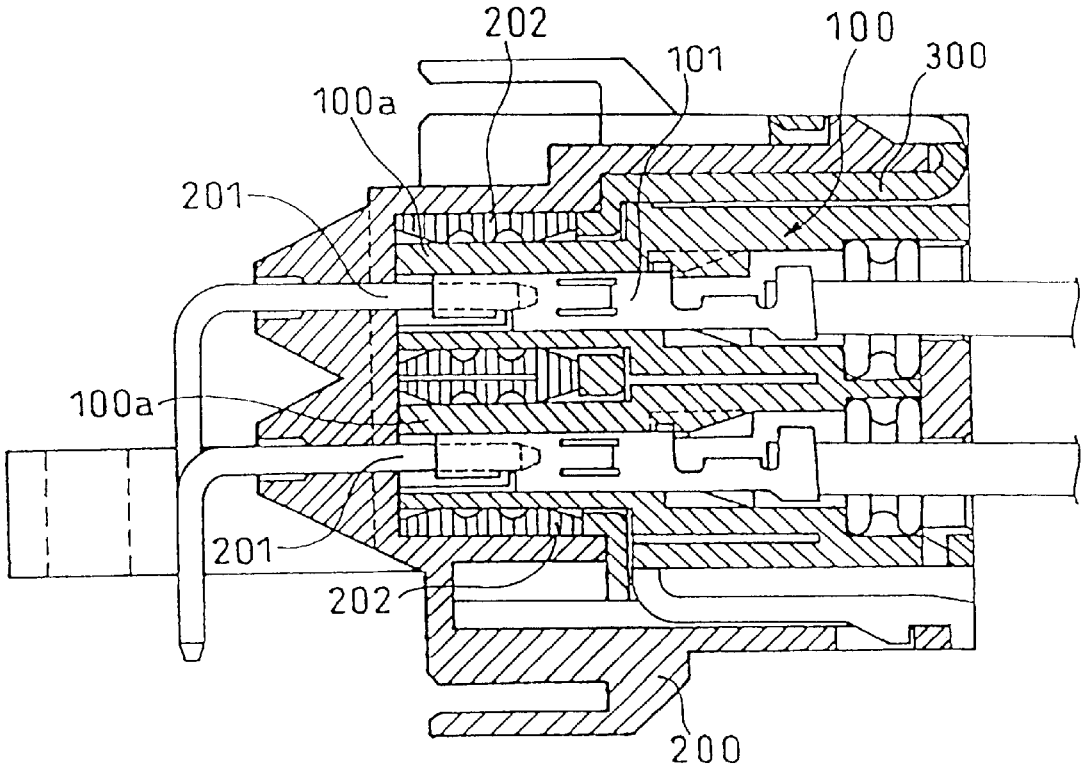
Fig. 11 CONVENTIONAL ART
FIG. 11 is a sectional view of a conventional connector.

FIG. 10 is a sectional view of the pin housing into which the socket housing 11A is inserted. In the same figure, the pin housing, indicated at 5A, has a socket receiving recess 7A which conforms to the shape of the socket housing 11A, with a sealing member 8A being mounted on the bottom of the socket receiving recess 7A. The pin housing 5A has male terminals 6A formed by molding integrally with the pin housing 5A, the male terminals 6A extending through the sealing member 8A and projecting inside the socket receiving recess 7A. In a ceiling portion of the pin housing 5A is provided a hook hole 18 for ensuring the coupling of the pin housing 5A and the socket housing 11A.

When the socket housing 11A (FIGS. 8 and 9) is inserted into the socket receiving recess 17A of the pin housing 5A, a front end of the socket housing 11, which front end has the same shape as an edge 9 of the socket housing 11, comes into abutment against the sealing member 8A. The socket housing 11A is inserted until engagement of the hook 16 with the hook hole 18, whereby the front end of the socket housing 11A and the sealing member 8A come into strong and close contact with each other, thus ensuring a reliable waterproofing effect.

According to this embodiment, as described above, the edge of the socket housing 11 or 11A is formed in an arcuate shape, and this arcuate edge is brought into abutment against the sealing member 8 or 8A to obtain a waterproofing effect. However, there may be adopted a construction wherein an annular projection which surrounds the male terminals 6 or 6A is formed on the sealing member 8 or 8A side, while the edge of the socket housing 11 or 11A is formed flat, and the annular projection is brought into abutment against the flat edge surface.

There may also be adopted any structure insofar as the socket housing and the pin housing are brought into close contact with each other through a sealing member having an abutting surface perpendicular to the housing connecting/disconnecting direction.

The shape of the surface against which the annular projection comes into abutment is not limited to a flat surface, but may be grooved in conformity with the constituent arcs of the annular projection. In this case, the groove is not limited to a groove which comes into abutment against the whole of the annular projection, but it may be a shallow groove which comes into abutment against a part of the annular projection, including at least the top portion of the annular projection.

Further, the sealing member 8 or 8A is not always required to be separate from the pin housing 5. It may instead be rendered integral with the pin housing at the time of molding.

According to the above embodiments, an end face (edge) of the socket housing perpendicular to the housing connecting/disconnecting direction may be brought into abutment against the elastic sealing member. Consequently, a frictional resistance at the time of connection or disconnection of the connector is reduced, thus facilitating the connection and disconnection of the connector. Further, a plurality of poles can be arranged in a small space.

Since the surface of the member opposed to the convex portion is deformed smoothly, a gap is unlikely to occur between the socket housing and the elastic sheet, and thus the sealing effect is enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waterproof electrical connector for connecting a plurality of male terminals and a plurality of female terminals, comprising:

a pin housing which holds the male terminals;

a socket housing having receptacle portions for accommodating and holding the female terminals; and an elastic sheet member including an annular groove so that a cylindrical edge of the socket housing comes into abutment against the elastic sheet member when the socket housing is fitted in the pin housing to form a seal between the pin housing and the socket housing, wherein the cylindrical edge of the socket housing having a similar shape as the annular groove of the elastic sheet.

2. The waterproof electrical connector of claim 1, wherein the receptacle portions have substantially rectangular transverse cross-sectional shapes.

3. The waterproof electrical connector of claim 1, wherein either the cylindrical edge of the socket housing or a surface of the elastic sheet against which the cylindrical edge comes into abutment has an arcuate convex portion.

4. The waterproof electrical connector of claim 3, wherein the convex portion includes a series of circular arcs having a single radius of curvature and is annular around the male or female terminals.

5. The waterproof electrical connector of claim 4, wherein an annular groove conforming to at least top portions of the circular arcs is formed in the surface against which the arcuate convex portion comes into abutment.

6. A waterproof electrical connector for connecting a plurality of male terminals and a plurality of female terminals, comprising:

a socket housing for the female terminals;

a pin housing for housing the male terminals, the socket housing being insertable into the pin housing to connect the male terminals with the female terminals; and a seal member, the seal member having an arcuate surface engageable with an end of the socket housing for forming a seal with the socket housing, wherein the arcuate surface and the end of the socket housing having similar shape.

7. The waterproof electrical connector of claim 6, wherein the seal member is elastic.

8. The waterproof electrical connector of claim 6, wherein the end portion of the socket housing has a cylindrical shape that conforms with the arcuate surface of the seal member.

9. A waterproof electrical connector for connecting a plurality of male terminals and a plurality of female terminals, comprising:

a pin housing which holds the male terminals, the pin housing having a hook hole;

a socket housing having receptacle portions for accommodating and holding the female terminals, the socket housing having a hook which deforms to permit coupling of the pin housing and the socket housing with each other; and an elastic sheet member including an annular groove so that a cylindrical edge of the socket housing comes into abutment against the elastic sheet member when the socket housing is fitted in the pin housing to form a seal between the pin housing and the socket housing, wherein the cylindrical edge of the socket housing having a similar shape as the annular groove of the elastic sheet.

10. The waterproof electrical connector of claim 9, wherein the hook is deformed by pushing a protuberance which is integral with the hook.

* * * * *